US005886602A

United States Patent [19]

Burel et al.

[11] Patent Number: 5,886,602

[45] Date of Patent: Mar. 23, 1999

[54] CONTACT-UNIT SLIDE FOR CONTACTORS

[75] Inventors: Michel Burel, Sevres; Jean-Pierre Duchemin, Jouy Le Moutier; Bruno Jacquet, Mantes La Ville, all of France

[73] Assignee: Schneider Electric SA, Boulogne Billancourt, France

[21] Appl. No.: 778,716

[22] Filed: Dec. 27, 1996

[30] Foreign Application Priority Data

Dec. 29, 1995 [FR] France ..... 95 15896

[51] Int. Cl.[6] ..... H01H 67/02; H01H 9/00

[52] U.S. Cl. ..... 335/132; 335/129; 200/243; 200/249; 200/250; 200/281

[58] Field of Search ..... 335/127–135; 200/16 A, 17 R, 243, 249, 250, 251, 280, 281, 286

[56] References Cited

U.S. PATENT DOCUMENTS 2,208,387 7/1940 Pierce ..... 200/166
2,532,305 12/1950 Heller ..... 200/165
4,431,978 2/1984 Lenzing ..... 335/132

FOREIGN PATENT DOCUMENTS 2 506 508 11/1982 France .

*Primary Examiner*—Renee S. Luebke
*Assistant Examiner*—Raymond Barrera
*Attorney, Agent, or Firm*—Oblon, Spivak, McClelland, Maier & Neustadt, P.C.

[57] ABSTRACT

A contact-unit slide for contractors which includes an insulating body in which windows are drilled wherein in each of these windows a contact bridge and a compression spring associated with the contacts are housed, the slide being moved by the mobile parts of the contactor's electromagnet, the spring bearing on the opposite side of the support surface adjacent to the contact bridge. The body has slots extending between a window and a visible surface to allow it to be supported on the upper end of the associated spring.

2 Claims, 2 Drawing Sheets

CONTACT-UNIT SLIDE FOR CONTACTORS

BACKGROUND OF THE INVENTION

1. Field of the Invention

This invention refers to a contact-unit slide for contactors, consisting of an insulating body in which windows are drilled and in each of which a contact bridge and a compression spring associated with the contacts are housed, the slide being moved by the mobile parts of the contactor's electromagnet.

DISCUSSION OF THE BACKGROUND

The contactors are equipped with a contact-unit slide fitted with contact bridges for drawing or suppressing current when this slide is moved by the mobile parts of an electromagnet. This slide serves as a guide for the mobile parts of an electromagnet to which it is connected. It has windows where the contact bridges are housed which are held in turn by compression springs also installed in the windows.

This slide is often made of a single solid part or of two parts assembled together. This design does not help facilitate the replacement of contact bridges subsequent either to contact wear-and-tear or to an incident such as the sticking of contacts. In fact, the compression springs are engaged at their ends and therefore are not easy to remove.

A contact-unit slide in which the contact bridge is secured to the slide's body by a removable system is known. This design is complicated and does not facilitate the replacement of contacts.

SUMMARY OF THE INVENTION

The purpose of this invention is to allow the interchangeability of mobile contacts and to facilitate the installation and removal of these mobile contacts.

In accordance with the invention, the slide is characterized in that the body has slots which extend between a window and the visible surface to allow pressing on the upper end of the associated spring.

According to one feature, one end of each spring is fitted to a centering pin forming a tilted section, while the opposite end is fitted to a centering pin with a base plate adjacent to the contact bridge.

According to one feature, each window has flanges serving like stops and co-operating with the centering pin at a tilted section to ensure the centering and the stopping of the spring transversally.

BRIEF DESCRIPTION OF THE DRAWINGS

The invention is now going to be described in more detail by referring to an embodiment given by way of example and represented by the accompanying drawings in which.

DESCRIPTION OF THE PREFERRED EMBODIMENTS

Figure 3:
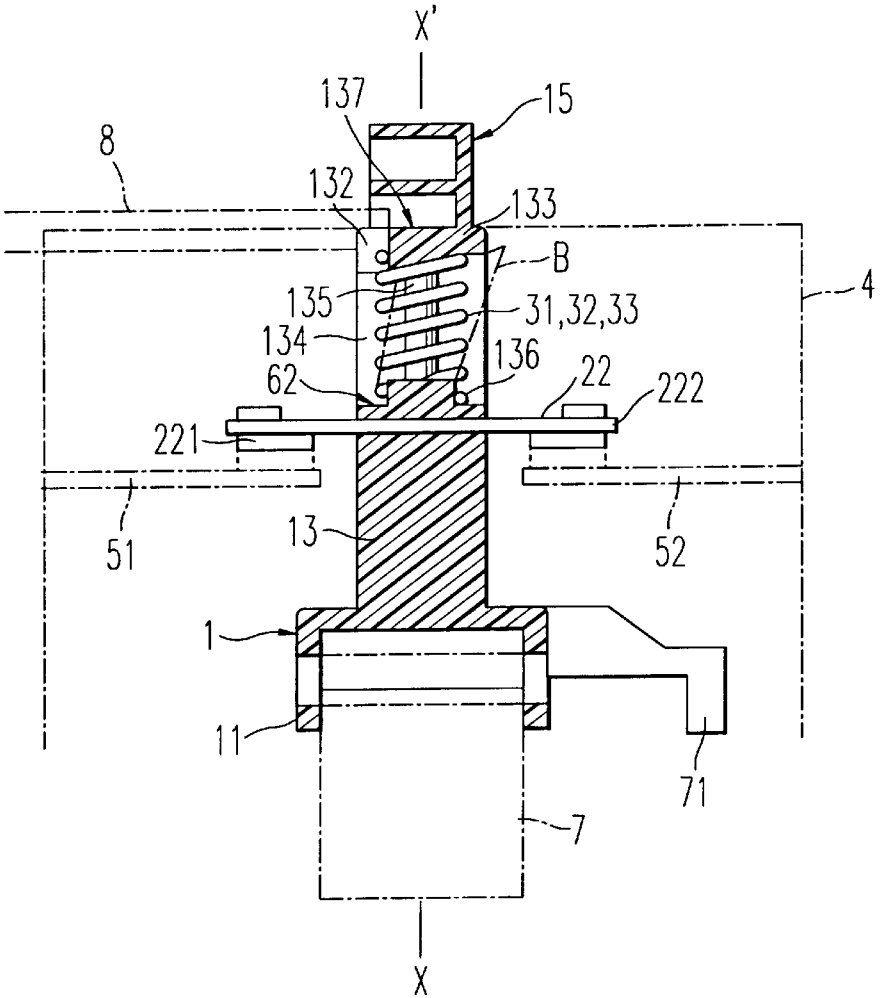
FIG. 3 is a cross section of FIG. 1, according to a plane parallel to the slide's direction of translation.
Figure 2:
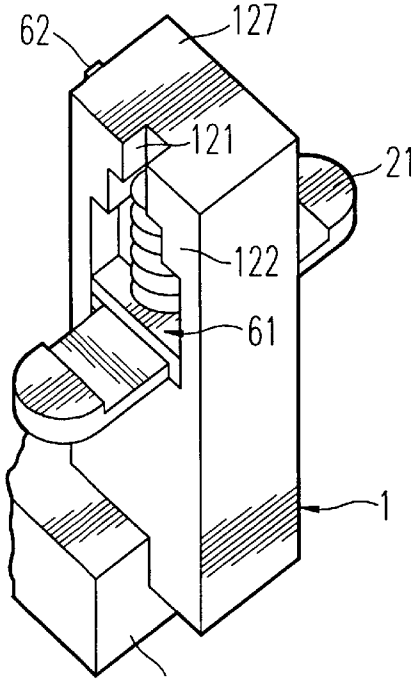
FIG. 2 is a detailed view of the slide.

Referring to FIG. 3, the arc case of an electromagnetic contactor is identified at 4. Inside the case (lower part) is housed mobile armature 7 of the electromagnet's magnetic circuit, whose function is to move contact bridges 21, 22, 23, thereby closing the power circuit or not, and are equipped with contacts such as 221 and 222, which co-operate with the fixed contacts of contact parts such as 51 and 52. Armature 7 is harnessed to a slide 1, which supports contact bridges 21, 22, 23. The contact parts are connected to power conductors.

The contact-unit slide 1 has a body made of plastic consisting of a base 11 which is used to connect the mobile armature 7 of the electromagnet and an extension 12, 13, 14 in which windows 124, 134, 144 are cut out and used to install contact bridges 21, 22, 23.

Contact bridges 21, 22, 23 are supported by columns 12, 13, 14 accommodating together slots in which the arc case's walls pass, which are used to isolate the arc chambers. Windows 124, 134, 144 are found, respectively, in columns 12, 13, 14.

The slide allows harnessing the control device of an additional part such as an auxiliary contact block or a pneumatic timer (not shown) thanks to a claw 15 molded to the end of the center column 13.

Each contact bridge 21 or 22 or 23 rests, in the open position of the contacts, on a support surface such as 136 of the window. On each contact bridge 21, 22, 23 a spring 31, 32, 33 housed in the windows presses and is held on the window's support surface such as 133, which is opposite the support surface adjacent to the contact bridge. The springs press on support base plates 61, 62, 63, which are in contact with the contact bridges.

Contact bridges 21, 22, 23 and base plates 61, 62, 63 are guided in translation according to a plane X-X'. Two side grooves such as 135 are provided on the sides of the windows parallel to X-X'. On each contact bridge there are two guide side slots which slide along two side grooves, 135, for example. Similarly, the support base plates have slots which slide along the same grooves. The contact bridges and the support base plates thus remain centered. The centering and guiding arrangements just described allow the contact bridges to assume an angular clearance in relation to the normal position (that is, perpendicular to plane X-X') and thereby slide in their respective windows.

Figure 1:
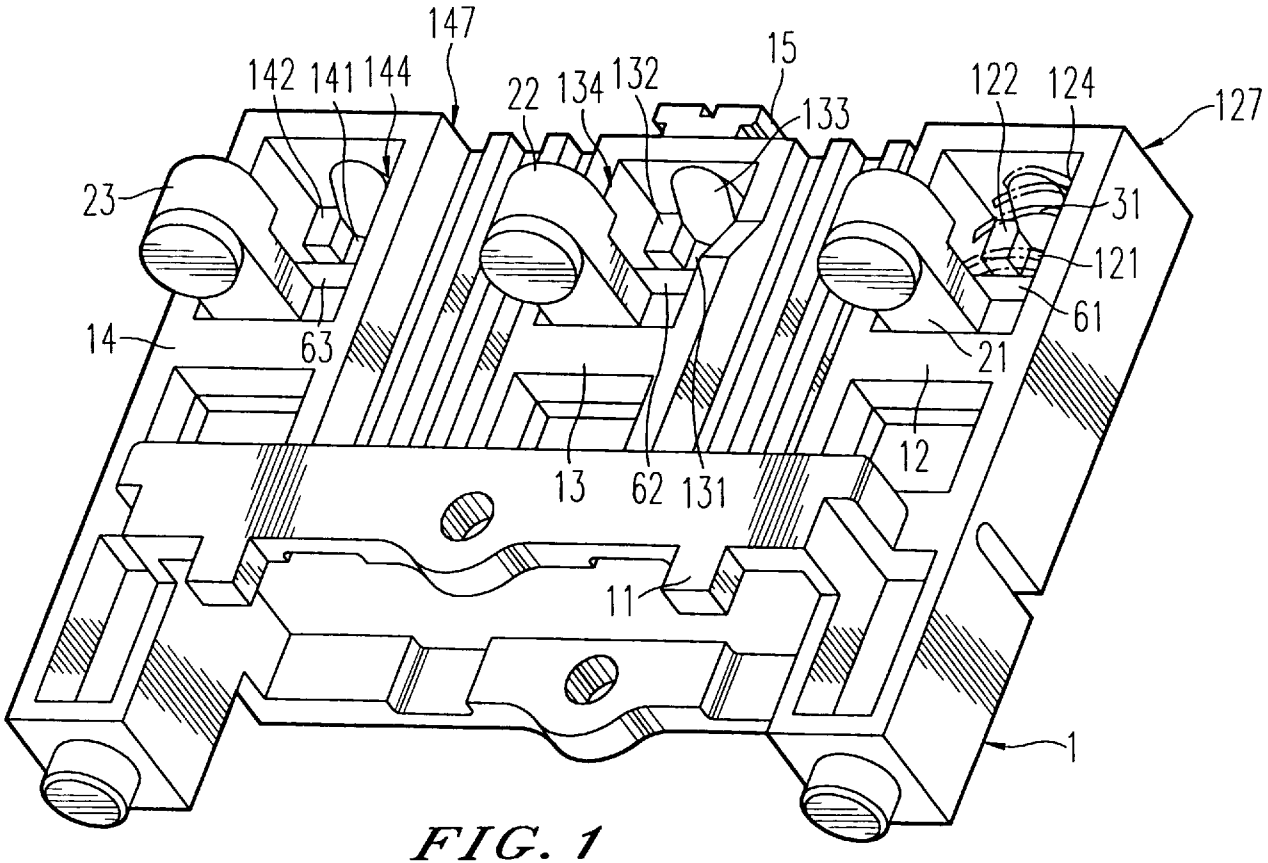
FIG. 1 is a perspective view of a contact-unit slide in accordance with the invention.

The slide's body is cut out by slots 121, 131, 141, each extending between a window and the slide's visible surface 127, 137, 147. Each spring is flush with a slot 121 or 131 or 141, which allows the operator to press by means of a tool 8 on the end turn of the spring. In FIG. 1, only one spring 31 is represented by dotted lines to simplify the drawing.

The frame of each window has on each side and on the top edge flanges or stops 122, 132, 142, which are designed to prevent the spring from disengaging from the window.

Each of the springs has one of its ends fitted to a centering pin projecting from a base plate 61, 62, 63, and the other end is engaged in a centering pin, such as 133, which projects into the window on the visible surface side. This last centering pin 133 forms a sloped section, whose height decreases in the direction in which stops 122, 132, 142 on the opposite side move.

Claw 15 allows the removal tool 8 to pass (FIG. 3) .

The procedure to follow for the removal of the springs and the contact bridges will now be explained.

In normal operation, the upper end of the spring associated with each contact bridge is centered by the associated pin such as 133. This spring end cannot slip off of the tilted section because of flanges 122 or 132 or 142, which serve as stops.

To proceed with the removal of a spring and the associated contact bridge, for example 31 and 22 (FIG. 3), the operator presses using the tool 8 (screwdriver) on the upper part of this spring, here 31. The upper end of this spring disengages from centering pin 133 and slides along the tilted section until it is in a released position, which is marked B on FIG. 3.

To proceed with the installation of a spring and the associated contact bridge, for example 31 and 22 (FIG. 3), contact bridge 21 equipped with a base plate 62 has to be inserted in the associated side grooves, such as 135, by rotating it slightly. Spring 31 supported on the base plate can then slide easily onto the sloped section of pin 133 to be positioned in its slot between pin 133 and both of the stops 132 without any danger of being incorrectly installed. The sloped section of pin 133 avoids having to compress the spring before inserting it into its slot, thereby limiting deformation by bending, which is the case with some devices in use today. A noise indicates at the end of installation that the assembly is correctly positioned.

Obviously, one can imagine within the framework of the invention variants and improvements in detail and even envision the employment of equivalent arrangements.

We claim:

1. A contact apparatus comprising:

an insulating body having a window defined by an upper and lower wall;

a contact bridge arranged on the lower wall in the window, said contact bridge having a support surface located thereon;

a compression spring provided between said support surface of said contact bridge and the upper wall in the window so as to urge said contact bridge toward the lower wall, said spring having a lower end which engages said support surface of said contact bridge;

a first centering pin formed on the upper wall inside the window and having a sloped section of decreasing height; and a base plate placed on said contact bridge and having a second centering pin on an upper surface of said base plate, an upper end of said compression spring being fitted on said first centering pin and said lower end of said compression spring being fitted on said second centering pin;

said insulating body having a slot which is formed on the upper wall such that said upper end of said compression spring which is positioned opposite said lower end of said spring is located in said slot; wherein said compression spring is removable from the window by pushing said upper end of said compression spring which is located in said slot and sliding said upper end of said spring along said tilted section of said pin to a release portion.

2. A contact apparatus according to claim 1, further comprising:

a stop formed on the upper wall inside the window which serves as a stopper for said compression spring in cooperation with said first centering pin.

* * * * *